United States Patent [19]

Tominaga et al.

[11] Patent Number: 4,862,059

[45] Date of Patent: Aug. 29, 1989

[54] FERRORESONANT CONSTANT AC VOLTAGE TRANSFORMER

[75] Inventors: Fukutoshi Tominaga, Fukuoka; Mitsuo Iwanaga, Saga; Hiromichi Yokomizo, Fukuoka, all of Japan

[73] Assignee: Nishimu Electronics Industries Co., Ltd., Jukuoka, Japan

[21] Appl. No.: 213,257

[22] Filed: Jun. 29, 1988

[30] Foreign Application Priority Data

Jul. 16, 1987 [JP] Japan ..... 62-177947

[51] Int. Cl.[4] ..... G05F 3/06; G05F 1/13

[52] U.S. Cl. ..... 323/307; 307/66; 323/215; 323/253; 323/254; 323/308; 336/5; 336/160

[58] Field of Search ..... 336/5, 155, 160; 323/248, 250, 253, 254, 307, 308, 215, 251; 307/83; 363/75

[56] References Cited

U.S. PATENT DOCUMENTS

| | | | |
|---|---|---|---|
| 3,398,292 | 8/1968 | Kuba | 323/308 |
| 3,531,708 | 9/1970 | Kuba | 336/5 |
| 3,889,176 | 6/1975 | Randall | 323/248 |
| 4,665,322 | 5/1987 | Eishima et al. | 323/215 |

FOREIGN PATENT DOCUMENTS

| | | | |
|---|---|---|---|
| 2155903 | 5/1972 | Fed. Rep. of Germany | 336/5 |

*Primary Examiner*—William H. Beha, Jr.
*Attorney, Agent, or Firm*—Kinney & Lange

[57] ABSTRACT

Primary and secondary windings of each transformer in a three-phase system each form a pair of independent windings, the first winding of each of the primary and secondary pairs formed on the iron core of one of the transformers and the second winding of each of the primary and secondary pairs formed on the iron core of the transformer adjacent thereto are connected in series to each other. These serially connected windings are regarded as one phase winding respectively, and they are connected to each other in either a delta connection or a Y connection. A variation in the voltage phase caused by a change in the load current of one of the system outputs has an influence not only on the phase of the voltage at that output but also on the phase of the voltages on the outputs adjacent thereto and consequently enables the deviation in the phase difference between the output phase voltages due to loss of balance of the load to be decreased to about one half. When the leg parts of two adjacent iron cores are juxtaposed and a common winding is formed on the juxtaposed leg parts so that one winding may function equivalently as two windings connected in series, the number of windings required in all is one half of the number of windings required where the windings are formed independently on the leg parts of the cores.

13 Claims, 8 Drawing Sheets

FERRORESONANT CONSTANT AC VOLTAGE TRANSFORMER

BACKGROUND OF THE INVENTION

1. Field of the Invention:

This invention relates to a ferroresonant three-phase constant AC voltage transformer and, more particularly, to a ferroresonant three-phase constant AC voltage transformer capable of lowering a deviation possibly generated in the phase difference between the output phases when an unbalanced load is connected thereto.

2. Description of the Prior Art:

A ferroresonant constant AC voltage circuit has a configuration wherein a series circuit consisting of a reactor L2 and a switching element SW are connected in parallel to an output capacitor C and to a load R each of the latter two being connected in parallel to each other. These parallel circuits, and a reactor L1 connected in series therewith, are connected in series to an input voltage Ei as illustrated in FIG. 10. By controlling the ON-OFF time of the switching element SW with a negative feedback circuit FBC and consequently controlling the input current flowing through the reactor L1, the amount of the voltage drop between the opposite terminals of the reactor L1, serially connected between the input and output, can be regulated and the AC voltage Eo applied to the output or load can be kept constant (as disclosed in U.S. Pat. No. 4,642,549 specification).

In the present specification, the output capacitor C, the reactor L2, the switching element SW, and the negative feedback circuit FBC may be referred to collectively as "automatic voltage regulating part (AVR)."

It is permissible, as is widely known, to utilize as the series reactor L1 a leakage inductance of a transformer T which is provided with a magnetic shunt Ms as illustrated in FIG. 9. In this arrangement, it is no longer necessary to add any series reactor as an external circuit component. FIG. 10, therefore, is an equivalent circuit of FIG. 9.

As examples of the transformer provided with a magnetic shunt, not only diport transformers configured as illustrated in FIG. 9 but also triport transformers (Japanese Patent Application Disclosure SHO 60(1985)-219,928 and Japanese Patent Application Disclosure SHO 61(1986)- 54,513) have been known to the art.

In the conventional constant voltage circuit described above, a phase difference occurs between the phase of the input voltage Ei and the phase of the output voltage Eo because the output voltage Eo is regulated to a target (fixed) value by controlling the magnitude of the electric current flowing in the reactor L1 which is serially connected between the input and output. This phase difference depends on the magnitude of the output current and the power-factor of the output (load R). When three constant voltage circuits such as described above are assembled in a three-phase connection and utilized as a three-phase power source, deviations in the phase differences between the input and output voltages cause deviations between the phases of three phase voltages.

When the output load is balanced among the three phases, since the deviations in phase between the input and output voltages are equal for all three phases, each of the phase differences between the output voltage phases is 120° where each of the phase differences between the three input voltage phases is 120°. When the load is unbalanced, the phase difference between the input and output voltages is likewise unbalanced among the phases and, as a result, the phase differences of the output phase voltages deviate from 120°.

For example, in a three-phase constant voltage circuit using three diport transformers T1 to T3 as illustrated in FIG. 11, the voltage vectors which are obtained when a load R is applied only on the output U phase of the circuit and no load is applied to the other V and W phases will be as illustrated in FIG. 12.

In the circuit of FIG. 11, there is connected in series to the primary (input) windings 12, 22, and 32 of the diport transformers T1 to T3, corresponding ones of series reactors L1r to L1t, respectively. These three series reactor-primary winding sets are joined together as phase windings in a delta-connection having input terminals R, S, and T.

The secondary (output) terminals of the diport transformers have corresponding automatic voltage regulating means AVRu to AVRw of the same configurations as in FIG. 9 and FIG. 10 joined together in a Y connection. N stands for a neutral point. In this case, as clearly noted from the diagrams, a voltage drop Vl occurs only in the series reactor L1r of the U phase while no voltage drop occurs in the reactors L1s and L1t of the V phase and the W phase. As the result, a phase delay of an amount $\phi$ occurs as illustrated in FIG. 12 in the voltage vector Vun of the output voltage on output U while no phase delay occurs in the voltage vectors Vvn and Vwn of the other voltages present on outputs V and W. As the result, there arises a loss of balance such that the resulting phase differences between the output voltages becomes $(120°-\phi)$ between voltages on outputs U and V, 120° between those on outputs V and W, and $(120°+\phi)$ between those on outputs W and U.

When such a deviation occurs in the phases of the output voltages of a three-phase power source device, a three-phase motor used as a load may generate a torque ripple to provide a possible cause for system noise. When a frequency triplicator (multiplier) is used, the deviation of the sort mentioned above may impair the frequency multiplier's capacity for operation. In an extreme case, this deviation may prevent the frequency multiplier from effecting the multiplication aimed at, degrade the frequency multiplier's capability of keeping constant voltage, and entail various other similar drawbacks.

In the United States, for example, the deviation in the phase difference is required to be prevented from exceeding 3° in a 30% unbalanced load (a load operated under the conditions of 70% in the U phase, 100% in the V phase, and 100% in the W phase, for example). Any attempt at meeting this requirement, however, entails a degradation of the power factor. It is not easy to keep both phase difference and power factor within their allowable limits.

One conceivable way of diminishing the deviation in the phase difference may consist of decreasing the magnitude of the series reactance. This measure, however, entails a disadvantage in that the power capacity on the primary side must be increased because the constant voltage characteristic is degraded and the current-limiting effect to be manifested in the case of secondary short circuit is impaired.

This invention has been made for the purpose of solving all the drawbacks of the prior art mentioned above.

SUMMARY OF THE INVENTION

For the solution of the drawbacks, the present invention contemplates a configuration comprising three iron cores with one for each corresponding input supply phase, a pair of primary windings formed on each of the iron cores, a pair of secondary windings formed on each of the iron cores, a series reactor serially connected to the input terminal of each of the input supply phases and to one end of a first primary winding formed on the iron core corresponding to the phase, means for connecting in series the first primary winding of one of the iron cores to a second primary winding formed on the iron core adjacent thereto, means for connecting together the first primary winding formed on one of the iron cores, the series reactor corresponding thereto, and the second primary winding formed on the adjacent iron core which are connected together in series as one primary phase winding in a selected connection pattern to the relevant input supply terminals, means for connecting in series the first secondary winding of one of the iron cores to a second secondary winding formed on the iron core adjacent thereto, and means for connecting together the first secondary winding formed on one of the iron cores and the second secondary winding formed on the adjacent iron core which are connected together in series as one secondary phase winding in a selected connection pattern to the relevant output terminals.

Since the primary and secondary windings of the transformer are each formed of two independent windings, the first winding formed on one of the iron cores and the second winding formed on the adjacent iron core are connected in series to each other, and since these serially connected windings are regarded as one phase winding respectively and are connected to each other selectively in delta connection or Y connection as described above, a change in the voltage phase caused by a change in the load current at one of the outputs has an influence not only on the phase of the voltage at that output but also on the phase of the voltage on the outputs adjacent thereto and consequently enables the deviation in the phase difference between the output voltages due to loss of balance of the load to be decreased by about one half.

Further, when the leg parts of two adjacent iron cores are juxtaposed and a common winding is formed on the juxtaposed leg parts so that one winding may function equivalently as two windings, the number of windings required in all is one half of the number of windings required where the windings are formed independently on the leg parts of the cores. The transformer of this invention, therefore, is capable of attaining the operation and effect mentioned above without any substantial increase in the number of windings as compared with the conventional transformer.

DETAILED DESCRIPTION OF THE PREFERRED EMBODIMENTS

Figure 1:
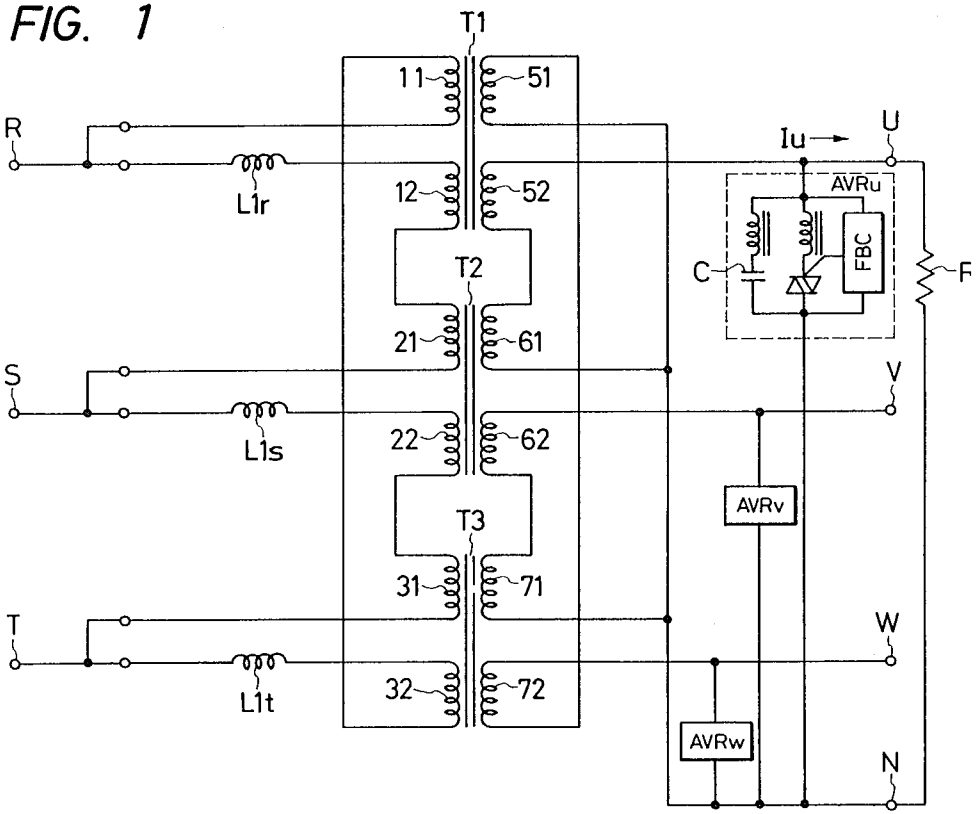
FIGS. 1, 3, 4, and 5 are circuit diagrams illustrating in schematic form the preferred embodiments of the present invention.

FIG. 1 is a circuit diagram illustrating in schematic form the construction of one working example of this invention.

The transformers T1, T2, and T3 associated with each input supply phase are each provided with mutually equivalent paired primary (input) windings 11 and 12, 21 and 22, and 31 and 32, respectively. The transformers T1, T2, and T3 are likewise provided with mutually equivalent paired secondary (output) windings 51 and 52, 61 and 62, and 71 and 72, respectively.

Of the paired primary windings of these transformers, the input second windings 12, 22, and 32 are connected, each at one end thereof, to the three-phase input supply terminals R, S, and T, respectively, through series reactors L1r, L1s, and L1t, respectively. Each of these input second windings 12, 22 and 32 is connected at the other end thereof to one end of the input first windings 21, 31, and 11 of the adjacent, in a circular sense, transformers T2, T3 and T1, respectively. The remaining ends of the input first windings 11, 21, and 31 are directly connected to the corresponding three-phase input supply terminals R, S, and T, respectively.

In other words, on the primary sides of the transformers, the series reactor and the second winding of one of the transformers and the first winding of the adjacent, in a circular sense, transformer are connected in series and are treated as a single phase winding all of which are joined together in a delta connection.

On the secondary sides of the transformers, the output second windings 52, 62, and 72 are directly connected, each at one end thereof, to the three-phase output supply terminals U, V, and W, respectively, and connected, each at the other end thereof, to one end of the output first windings 61, 71, and 51, respectively, of the adjacent, in a circular sense, transformer. The remaining ends of the output first windings 51, 61, and 71 are directly connected to a neutral point N.

Further on the secondary transformer sides, similar to the primary sides mentioned above, the output second winding of one of the transformers and the output first winding of the adjacent, in a circular sense, transformer are connected in series and are treated as a single phase winding all of which are joined in a Y connection.

Figure 10:
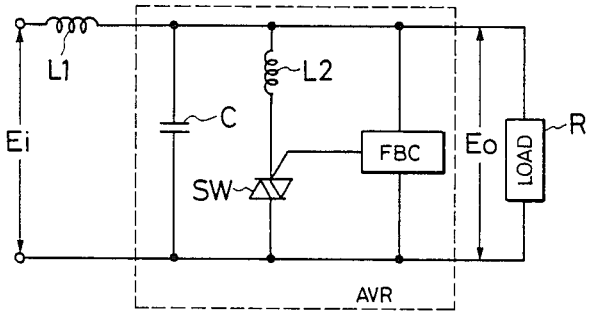
FIG. 10 PRIOR ART
FIG. 10 is an equivalent circuit of the circuit configuration shown in FIG. 9.
Figure 11:
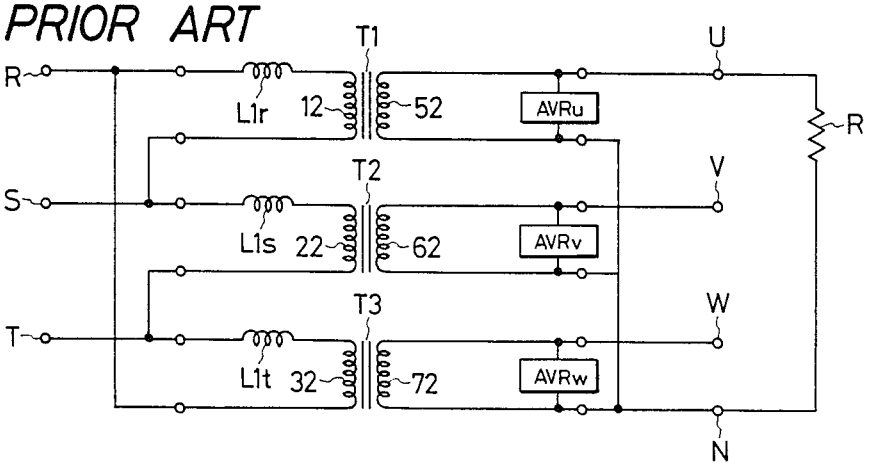
FIG. 11 PRIOR ART
FIG. 11 is a circuit diagram of a conventional ferroresonant three-phase constant voltage transformer.

Constant voltage regulating means AVRu, AVRv, and AVRw are inserted respectively between the neutral point N and the output supply terminals U, V, and W. These constant voltage regulating means may be arranged similarly to the conventional types illustrated in FIG. 10 or may be suitably arranged otherwise.

In FIG. 1, the AVR circuits are illustrated as having a reactor connected in series with an output capacitor C. Optionally, this reactor may be omitted.

Now, the circuit of FIG. 1 will be considered below with respect to a configuration having a load R connected between the output terminal U and the neutral point N and having the other output terminals left open or kept under no load.

The load current Iu flowing through the U output flows through the secondary windings 52 and 61 of the transformers T1 and T2 and, as the result, the corresponding transformer primary current flows through the series reactor L1r and the primary windings 12 and 21 of the same transformers. The voltage drop produced between the opposite terminals of the series reactor L1r by the primary current gives rise to a phase delay of 2Θ in the output voltage Vun on output U. Since the primary windings 12 and 21 are substantially equivalent, a phase delay of roughly Θ occurs in each of these windings.

As clearly noted from FIG. 1, a current with a phase delay of Θ flows in the series reactor L1s and the primary winding 22 because the primary winding 21 is magnetically coupled through transformer T2 to the primary winding 22 and to the secondary winding 62. As a result, the phase of the output voltage Vvn on output V is delayed similarly by Θ.

In the same manner, a current with a phase delay of Θ flows also in the series reactor L1t and the primary winding 32 because the primary winding 11, which is magnetically coupled to winding 12 through transformer T1, is serially connected to the primary winding 32. As a result, the phase of the output voltage Vwn on output W is also delayed by Θ.

Figure 2:
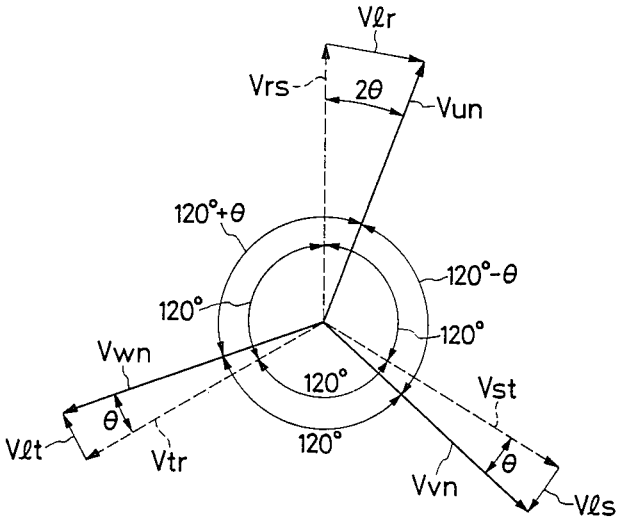
FIG. 2 is a vector diagram for explanation of the operation of the present invention.

As can be surmised from the explanation given above, the voltage phases on the input and output sides are related as indicated by the vector diagram of FIG. 2. FIG. 2 depicts the output voltage Vun on output U as having a phase delay of 2Θ relative to the input voltage Vrs on input R, the output voltage Vvn on output V as having a phase delay of Θ relative to the input voltage Vst on input S, and the output voltage Vwn on output W as having a phase delay of Θ relative to the input voltage Vtr on input T.

Figure 12:
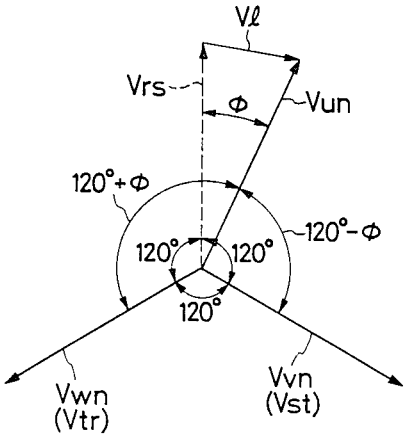
FIG. 12 PRIOR ART
FIG. 12 is a vector diagram for explanation of the operation of the device of FIG. 11.

It follows that the phase differences between output voltages is (120°−Θ) between the voltages on outputs U and V, 120° between those on outputs V and W, and (120°+Θ) between those on outputs W and U. Thus, the deviation in the phase difference between the output voltage phases is ±Θ, representing an improvement of roughly ½ over the conventional prior art as can be seen by comparing FIGS. 2 and 12.

The preceding embodiment has assumed using a plurality of windings on the transformers which are equivalent and balanced mutually. It will be readily inferred that substantially the same effect is obtained even when these windings are not perfectly balanced.

In the case of windings which are out of balance, the phase delay in the voltage on output U is (Θv+Θw) when the phase delay in the voltage on output V is Θv and the phase delay in the voltage on output W is Θw. It follows that the phase differences between output voltages is (120°−Θw) between the voltages on outputs U and V, (120°+Θw−Θv) between those outputs V and W, and (120°+Θv) between those on outputs W and U.

The embodiment under discussion, owing to the special devices emplyed in the construction and connection of the transformers T1 to T3, brings about an effect of decreasing the deviation in phase difference between the output voltage phases during the operation of an unbalanced load to about one half of the deviation involved in the conventional prior art without requiring any reduction in the reactance of the series reactors.

Figure 3:
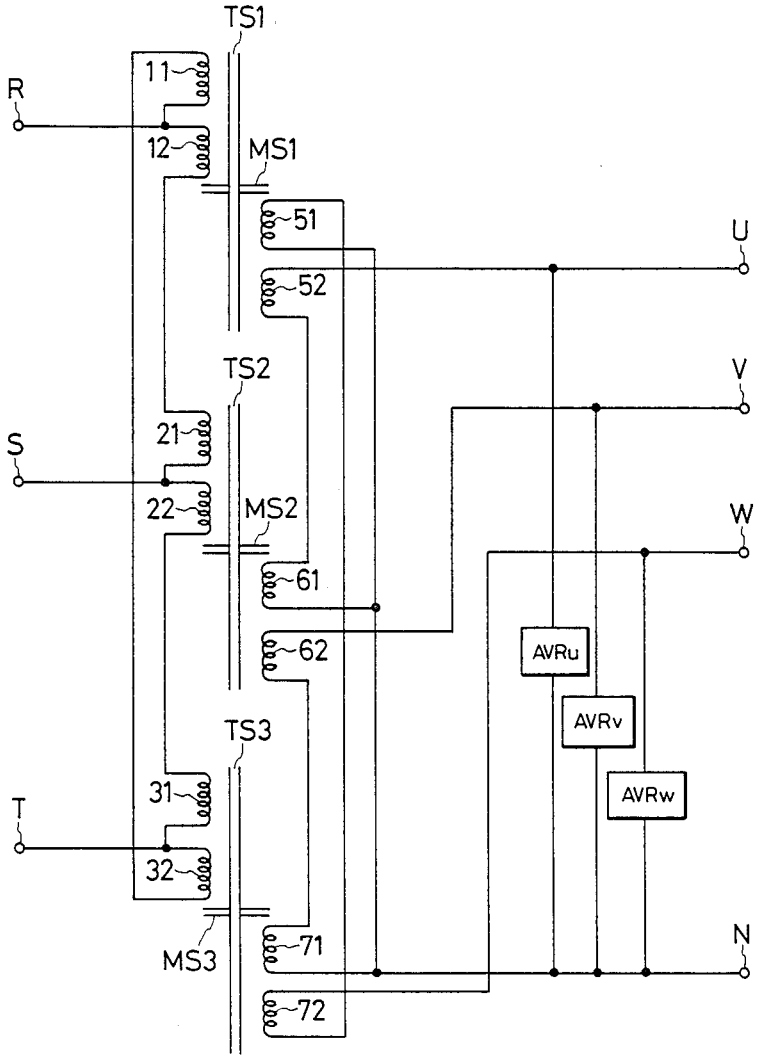

Evidently, the circuit of FIG. 1 can be realized by using diport transformers which are provided with magnetic shunts. One example of this configuration is illustrated in FIG. 3. In this diagram, the same symbols as used in FIG. 1 denote identical or equivalent parts.

TS1 to TS3 stand for diport transformers provided respectively with magnetic shunts. These diport transformers contribute to simplifying the configuration by obviating the necessity for using series reactors as external circuit elements. Since they have entirely the same operation as those of FIG. 1, the explanation thereof will be omitted.

Figure 4:
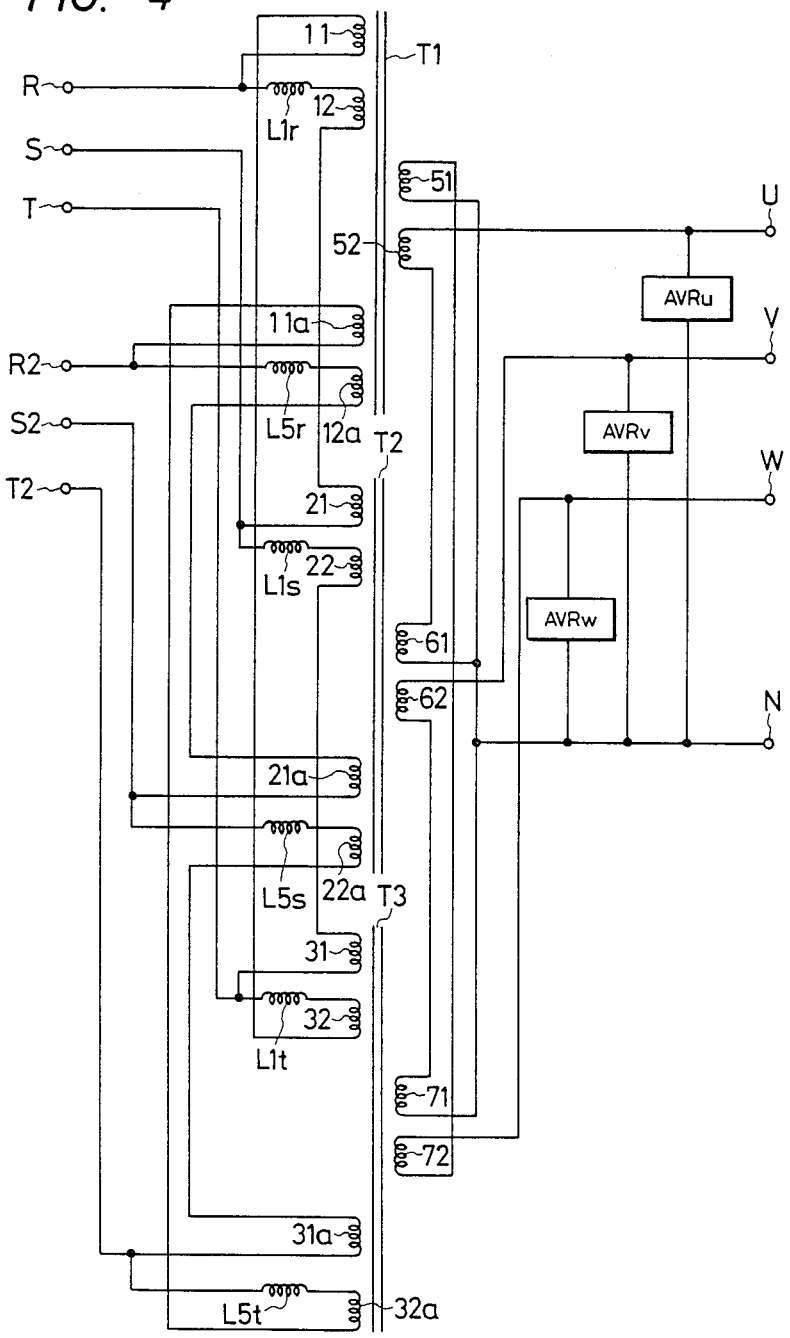

The circuit having the configuration of FIG. 1 can be applied to a two-way uninterruptible AC power supply using an inverter output as well as the conventional commercial AC power supply as inputs. One example of the application is illustrated in FIG. 4. In the diagram, the same symbols as used in FIG. 1 denote identical or equivalent parts.

As clearly noted from FIG. 4 as compared with FIG. 1, the present embodiment represents a configuration involving addition of windings 11*a*, 12*a*, 21*a*, 22*a*, 31*a* and 32*a* and series reactors L5r to L5t for the second input power supplies (R2, S2, and T2) on the primary sides of the transformers T1 to T3.

Since the operation of this embodiment is easily inferred from the operation of the conventional two-way uninterruptible AC power supply as shown in the U.S. Pat. No. 4,556,802 specification and from the description given above, the explanation of the operation will be omitted.

Figure 5:
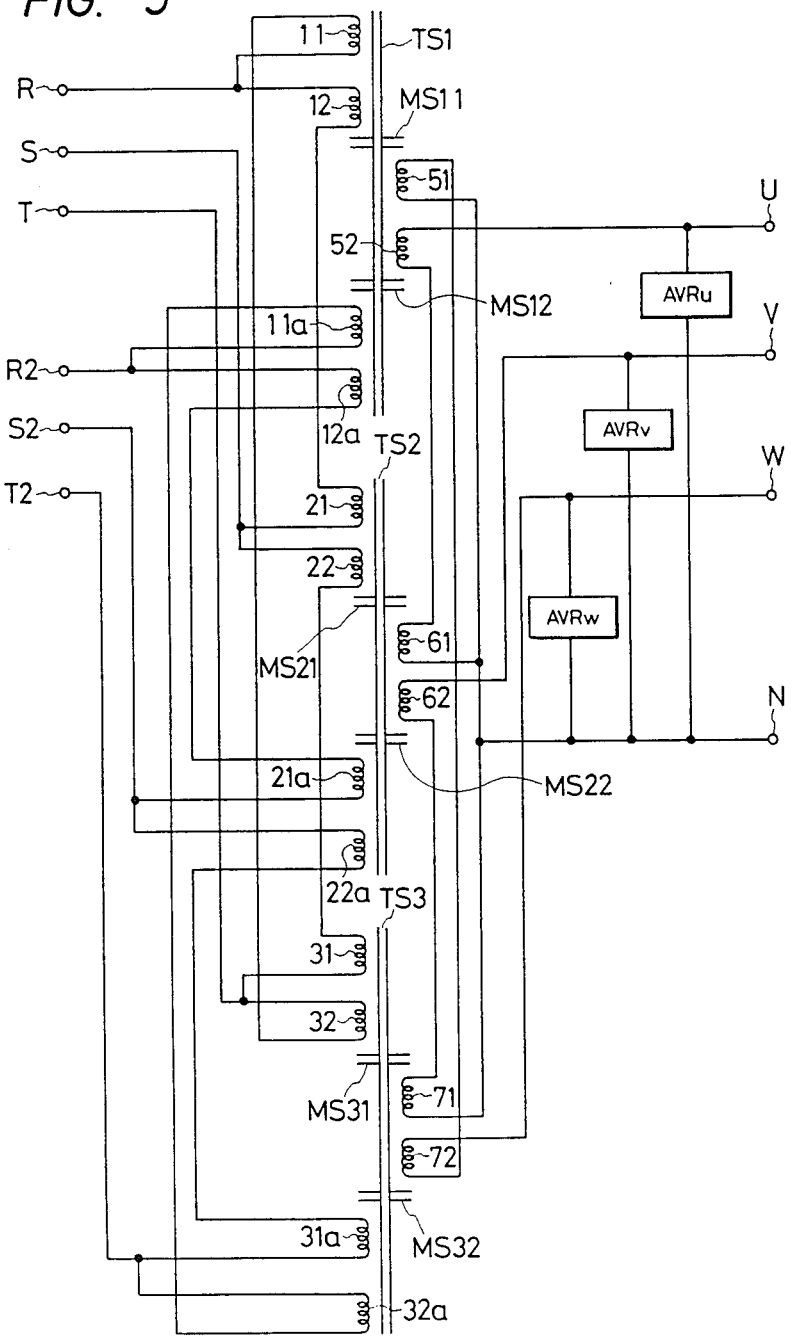

FIG. 5 depicts an embodiment realizing the circuit of FIG. 4 with three triport transformers. In this diagram, the same symbols as used in FIG. 3 and FIG. 4 denote identical or equivalent parts. MS11, MS12, MS21, MS22, MS31 and MS32 denote magnetic shunts for the triport transformers TS1 and TS3.

The fact that the embodiment of FIG. 5 has the same operation as that of FIG. 4 is easily inferred from the operation of the conventional two-way uninterruptible AC power supply and from what has been described so far.

In the embodiments described above, the ferroresonant three-phase constant AC voltage transformer contemplated by this invention is invariably provided by using three independent transformers one each for the three input supply phases and formed with a plurality of windings on each of the transformers.

As noted from what has been described so far, it is desirable for the sake of this invention that the electric properties (magnitude of resistance, magnitude of inductance, and number of turns) of the paired windings (such as, for example, the windings 11 and 12, 11*a* and 12*a*, 12 and 21, and 52 and 61) should be mutually equal.

For this purpose, the adoption of the bifilar winding for windings to be formed on a single transformer is effective. In the case of windings to be formed on different transformers, since no similarly effective measure is available, it is difficult to form paired windings possessing nearly identical electric properties.

Further, since the number of windings is substantial, the configuration entails a disadvantage in that it is large and heavy, consumes much time and labor in manufacture and assembly, and so becomes expensive.

Figure 6:
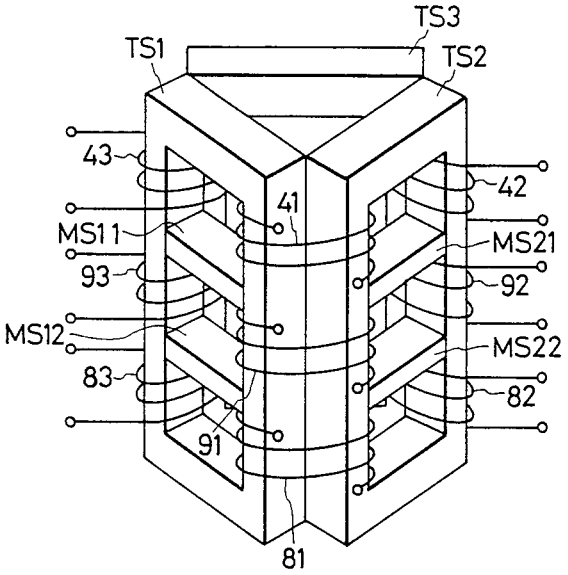
FIG. 6 is a perspective view illustrating in schematic form yet another embodiment of this invention.

FIG. 6 is a perspective view illustrating in schematic form another embodiment of this invention which is suitable for the elimination of the transformer and winding drawbacks of the nature described above. The embodiment of FIG. 6 corresponds to that of FIG. 5. In other words, the equivalent circuit of the configuration of FIG. 6 is as shown in FIG. 5.

Figure 7:
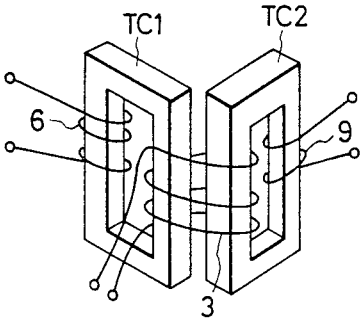
FIG. 7 is a perspective view of a transformer for explanation of the basic operating principle of the device of FIG. 6.
Figure 8:
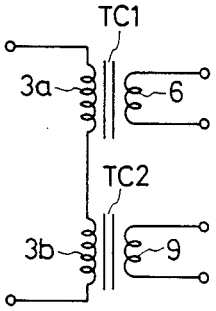
FIG. 8 is an equivalent circuit diagram of the device shown in FIG. 7.
Figure 9:
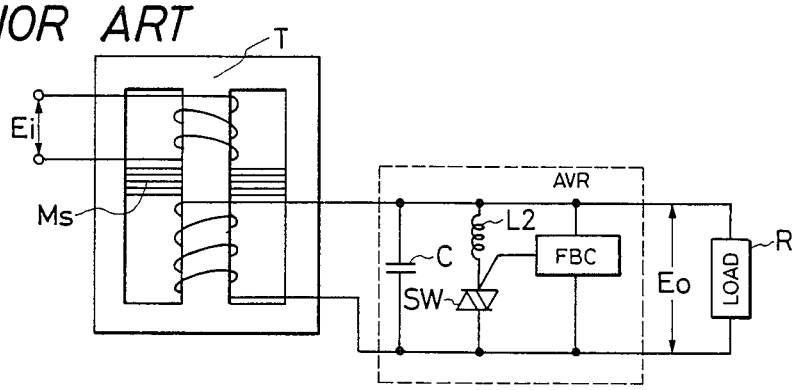
FIG. 9 PRIOR ART
FIG. 9 is a diagram illustrating a circuit configuration of the conventional ferroresonant constant voltage transformer.

This embodiment makes use of the following basic operating principle. As illustrated in FIG. 7, the adjacent legs, formed by one long side each of a pair of rectangular frame-shaped iron cores TC1 and TC2 are juxtaposed and a common winding 3 is formed on these juxtaposed legs. Separate windings 6 and 9 are formed respectively on the remaining long sides or legs of the iron cores TC1 and TC2, respectively. The transformer thus configured has an equivalent circuit as illustrated in FIG. 8. As apparent from FIGS. 7 and 8, applying a common winding on a part of each magnetic path of the two transformers is equivalent to forming independent windings on the magnetic paths and connecting such separate windings in series.

In the configuration of FIG. 6, three transformers TS1 to TS3 are each formed of a rectangular frame-shaped iron core each having a corresponding pair of magnetic shunts MS11 and MS12, MS 21 and MS22, or MS31 and MS32 (which are partly hidden in the diagram) to thereby form three winding sections (windows).

These transformers are placed together approximately in the shape of three faces of a triangular prism so that the adjacent leg parts of two of the three transformers will stand side by side as illustrated in FIG. 6. Common windings are formed on adjacent pairs of legs for each of the three pairs of adjacent legs. Since the iron cores are each divided into three winding sections by pairs of magnetic shunts as described above, the windings are formed with one in each pair of adjacent winding sections for each adjacent pair of cores.

In the illustrated configuration of FIG. 6, one set of output windings 91, 92 and 93 is formed in the corresponding second winding sections at the center of adjacent pairs of cores. Two sets of input windings 41 to 43 and 81 to 83 are formed, respectively, in the corresponding ones of the first adjacent winding sections and in the corresponding ones of the third winding sections in the upper and lower parts of adjacent pairs of cores.

The output winding 91 in the configuration of FIG. 6 corresponds to the output windings 52 and 61 in the configuration of FIG. 5. The other windings in the configuration of FIG. 6 correspond to corresponding series connected pairs of windings in the configuration of FIG. 5. Thus, it is easily inferred that the configuration of FIG. 6 corresponds to the transformers of FIG. 5.

Figure 15:
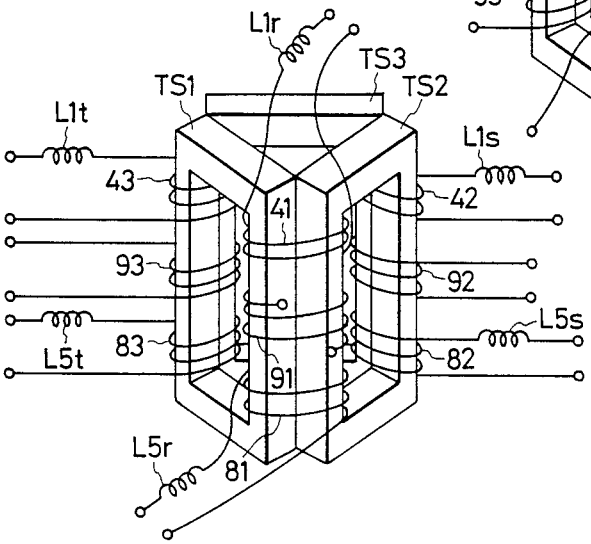

It is also clear that the transformers of the circuit illustrated in FIG. 4 are realized by the configuration in FIG. 15. The configuration of FIG. 15 is equivalent to the configuration of FIG. 6 based on removing all of the magnetic shunts from the iron cores TS1 to TS3 and connecting series reactors to the input windings 41 to 43 and 81 to 83.

Figure 13:
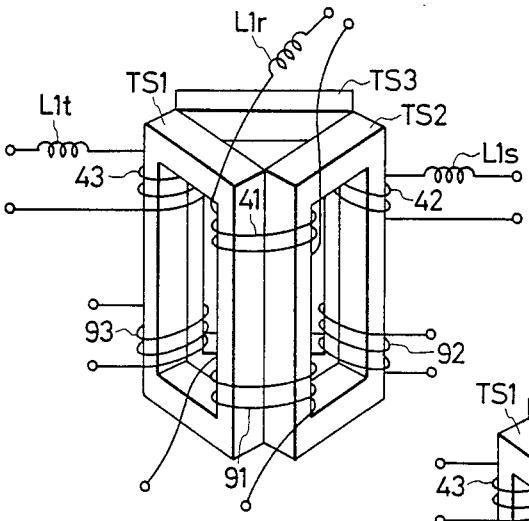
FIGS. 13 through 15 are perspective views illustrating still other embodiments of this invention.
Figure 14:
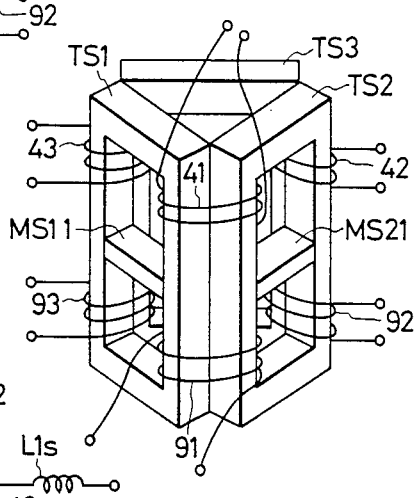

It is further evident that the transformers of the embodiments of FIG. 1 and FIG. 3 are realized by the configurations shown in FIGS. 13 and 14, respectively. These embodiments are realized by assembling three iron cores similar to the embodiment of FIG. 6, and forming common input and output windings on adjacent leg pairs for each of the three adjacent leg pairs provided by the adjacent transformers. The configuration of FIG. 15 is that of FIG. 13 after removing one set of input windings. The configuration of FIG. 6 is that of FIG. 14 after removing one set of input windings and one set of magnetic shunts.

The embodiments described above have been assumed as using an automatic voltage regulating means of the type provided with a feedback circuit. As easily inferred from what has been described above, the automatic voltage regulating means may be some other suitable type. In the embodiments described above, the windings on the primary side have been assumed as being the delta connection pattern and those on the secondary side the Y connection pattern. Of course, any one of the two connection patterns mentioned above can be optionally adopted for the primary and secondary side winding connections. Effect of the Invention:

As is evident from the description given above, the present invention brings about the following effects:

(1) The deviation produced in phase difference among the output side phases when the three-phase load goes out of balance can be decreased.

(2) The power capacity on the input side can be minimized because the current-limiting effect is maintained by maximizing the magnitude of reactance of the series reactors inserted on the input side.

(3) The effects of (1) and (2) shown above can be realized by applying common windings on each to the leg parts of a pair of transformers of the adjacent phases without increasing the number of windings as compared with the conventional countertype.

What is claimed is:

1. A ferroresonant three-phase constant AC voltage transformer comprising:

three magnetically permeable cores, first and second primary windings formed on each of said magnetically permeable cores, first and second secondary windings formed on each of said magnetically permeable cores, three input terminals and three output terminals, three input means each providing a self-inductive reactance effectively in series with a corresponding one of said second primary windings formed on its said magnetically permeable core and a corresponding one of said first primary windings formed on another of said magnetically permeable cores to thereby form three primary phase circuit branches connected to said three input terminals in a selected one of star and delta connection patterns, and said first secondary windings each formed on its magnetically permeable core and each provided in series with a corresponding second secondary winding formed on another of said magnetically permeable cores to thereby form three secondary phase circuit branches connected to said three output terminals in a selected one of star and delta connection patterns.

2. The ferroresonant three-phase constant AC voltage transformer according to claim 1, wherein at least one of said input means is a magnetic shunt formed in one of said magnetically permeable cores.

3. The ferroresonant three-phase constant AC voltage transformer according to claim 1 wherein at least one of said input means is a series reactor connected between one said input terminal and that said second primary winding with which it corresponds.

4. A ferroresonant three-phase constant AC voltage transformer comprising:

three magnetically permeable cores.

first and second pairs of primary windings having first and second windings in each formed on each of said magnetically permeable cores, a pair of secondary windings formed on each of said magnetically permeable cores, two sets of three-phase input terminals and three output terminals, a first set of three input means each providing a self-inductive reactance effectively in series with a corresponding said second winding of a said first pair of primary windings formed on its said magnetically permeable core and a corresponding said first winding of another of said first pairs of primary windings formed on another of said magnetically permeable cores to thereby form a first set of primary phase circuit branches connected in a predetermined connection pattern to the three-phase input terminals of the first set, a second set of three input means each providing a self-inductive reactance effectively in series with a corresponding said second winding of a said second pair of primary windings formed its said magnetically permeable core and a corresponding said first winding of another of said second pairs of primary windings formed on another of said magnetically permeable cores to thereby form a second set of primary phase circuit branches connected in a predetermined connection pattern to the three-phase input terminals of the second set, and said first secondary windings of a said pair thereof each formed on its magnetically permeable core and each provided in series with a corresponding second secondary winding of another said pair thereof formed on another of said magnetically permeable cores to thereby form three circuit branches connected to said three output terminals in a selected one of star and delta connection patterns.

5. The ferroresonant three-phase constant AC voltage transformer according to claim 4, wherein at least one of said input means is a magnetic shunt formed in one of said magnetically permeable cores.

6. The ferroresonant three-phase constant AC voltage transformer according to claim 4 wherein at least one of said input means is a series reactor connected between one said input terminal and that said second primary winding with which it corresponds.

7. A ferroresonant three-phase constant AC voltage transformer comprising:

three magnetically permeable cores each having leg parts mutually juxtaposed with leg parts of each of the other two magnetically permeable cores to thereby form three pairs of such juxtaposed leg parts, three primary windings each formed about a different one of said three pairs of juxtaposed leg parts, three secondary windings each formed about a different one of said three pairs of juxtaposed leg parts, three input terminals and three output terminals, three input means each providing a self-inductive reactance effectively in series with a corresponding one of said primary windings to thereby form three primary phase circuit branches connected to said three input terminals in a selected one of star and delta connection patterns, and said secondary windings each forming one of three secondary phase circuit branches connected to said three terminals in a selected one of star and delta connection patterns.

8. The ferroresonant three-phase constant AC voltage transformer according to claim 7, wherein at least one of said input means is a magnetic shunt formed in one of said magnetically permeable cores.

9. The ferroresonant three-phase constant AC voltage transformer according to claim 7 wherein at least one of said input means is a series reactor connected between one said input terminal and that said second primary winding with which it corresponds.

10. A ferroresonant three-phase constant AC voltage transformer comprising:

three magnetically permeable cores each having leg parts mutually juxtaposed with leg parts of each of the other two magnetically permeable cores to thereby form three pairs of such juxtaposed leg parts, three pairs of primary windings having first and second windings in each, and with each of said pairs formed about a different one of said three pairs of juxtaposed leg parts, two sets of three-phase input terminals and three output terminals, three secondary windings each formed about a different one of said three pairs of juxtaposed leg parts, a first set of three input means each providing a self-inductive reactance effectively in series with a corresponding said first winding of a said pair of primary windings formed on its said pair of juxtaposed leg parts to thereby form a first set of primary phase circuit branches in a predetermined connection pattern to the three-phase input terminals of the first set, a second set of three input means each providing a self-inductive reactance effectively in series with a corresponding said second winding of a said pair of primary windings formed on its said pair of juxtaposed leg parts to thereby form a second set of primary phase circuit branches in a predetermined connection pattern to the three-phase input terminals of the second set, and said secondary windings each forming one of three secondary phase circuit branches connected to said three output terminals in a selected one of star and delta connection patterns.

11. The ferroresonant three-phase constant AC voltage transformer according to claim 10, wherein at least one of said input means is a magnetic shunt formed in one of said magnetically permeable cores.

12. The ferroresonant three-phase constant AC voltage transformer according to claim 11, wherein each of said magnetically permeable cores is divided with two magnetic shunts into three winding sections respectively with said first and second windings in a said pair of primary windings and a secondary winding together about one of said pairs of juxtaposed leg parts each being in one of said winding sections.

13. The ferroresonant three-phase constant AC voltage transformer according to claim 10 wherein at least one of said input means is a series reactor connected between one said input terminal and that said second primary winding with which it corresponds.

* * * * *

UNITED STATES PATENT AND TRADEMARK OFFICE

CERTIFICATE OF CORRECTION

PATENT NO. : 4,862,059

DATED : August 29, 1989

INVENTOR(S) : Fukutoshi Tominaga et al.

It is certified that error appears in the above-identified patent and that said Letters Patent is hereby corrected as shown below:

Column 10, line 5, after "three", insert therefore --output--.

Signed and Sealed this

Twenty-fourth Day of July, 1990

*Attest:*

HARRY F. MANBECK, JR.

*Attesting Officer*

*Commissioner of Patents and Trademarks*